US006054932A

United States Patent [19]

Gartner et al.

[11] Patent Number: 6,054,932

[45] Date of Patent: Apr. 25, 2000

[54] LED TRAFFIC LIGHT AND METHOD MANUFACTURE AND USE THEREOF

[76] Inventors: William J. Gartner, 6342 E. Alta Hacienda Dr., Scottsdale, Ariz. 85251; Christopher R. Myers, P.O. Box 1661, Basalt, Colo. 81621; Marco Messina, 11703 N. 123rd Way, Scottsdale, Ariz. 85259

[21] Appl. No.: 09/196,913

[22] Filed: Nov. 20, 1998

[51] Int. Cl.[7] ..... G08G 1/095

[52] U.S. Cl. ..... 340/815.65; 340/815.45; 340/907; 362/231 R

[58] Field of Search ..... 340/907, 908, 340/925, 944, 981, 982, 815.45, 815.65, 815.69; 362/231 R, 234, 252

[56] References Cited

U.S. PATENT DOCUMENTS

| | | | |
|---|---|---|---|
| 3,863,207 | 1/1975 | Galella | 340/907 |
| 3,983,532 | 9/1976 | Hayes | 340/907 |
| 4,271,408 | 6/1981 | Teshima et al. | 340/815.45 |
| 4,839,647 | 6/1989 | Patterson | 340/907 |
| 4,857,920 | 8/1989 | Kataoka et al. | 340/907 |
| 5,136,287 | 8/1992 | Borenstein | 340/925 |
| 5,898,381 | 4/1999 | Gartner et al. | 340/815.45 |

OTHER PUBLICATIONS

*Tech Update,* "LED Traffic Lights", by Chris Calwell Nov. 1995, pp. 0–16, published in Boulder, Colorado.

*E Source,* Chapter 13 "Special Applications: LED Traffic Lights" 1994, sections 13.1–13.2, published in Boulder, Colorado.

*Primary Examiner*—Daniel J. Wu

*Attorney, Agent, or Firm*—Richard G. Harrer; Steven Lin

[57] ABSTRACT

A new embodiment LED traffic light 40 having a housing 49 that provides at least three signal lights 42, 44, and 46. The three signal lights 42, 44, and 46 are all embedded in a single opening 50 of housing 49. The LEDs for signal lights 42, 44, and 46 are arranged in a generally common area that allows activation and display of one of the signal lights in a corresponding symbolic shape (i.e. universal symbol or words). Red signal light 42 has red LEDs 41 spread out and arranged in an octagon shape (i.e. stop sign shape). From a distance or afar, however, it may be difficult for persons to distinguish between the octagon shape and the circular shape (i.e. stop and go signals respectively). Therefore, a border 52 of contrasting color LEDs 54 (i.e. different color other than the color of the octagon) is placed around the octagon shape and illuminated to further enhance and define the stop sign or octagon shape thereof. The border 52 may be made to blink or flash (i.e. by blinking all of the LEDs 54). Green signal light 46 has green LEDs 45 spread out and arranged in a circular shape. In the areas which red signal light 42 and green signal light 46 commonly overlap, clusters of two LEDs (i.e. red LEDs 41 and green LEDs 45) exist. Yellow signal light 44 has yellow LEDs 43 spread out and arranged mounted in a triangle shape. In the areas which the three signal lights 42, 44, and 46 commonly overlap, clusters of three LEDs (i.e. red LEDs 41, yellow LEDs 43, and green LEDs 45) exist. Another new embodiment LED traffic light 40B has a number of LED clusters 51B within an entire area 50B. Each cluster 51B has at least four different colored LEDs: a red LED 41, a yellow LED 43, a green LED 45, and a contrasting colored LED 54. The new traffic light 40B is programmed to activate the LED clusters 51B so that the desired traffic information (i.e. traffic signal, border, text, etc.) is displayed.

20 Claims, 3 Drawing Sheets

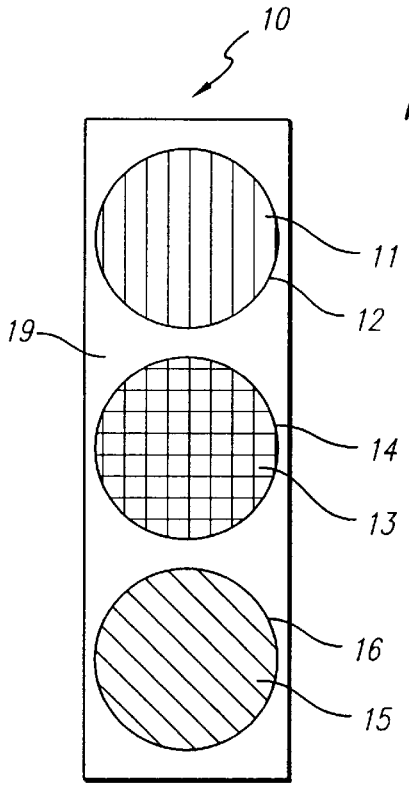
FIG. 1
PRIOR ART
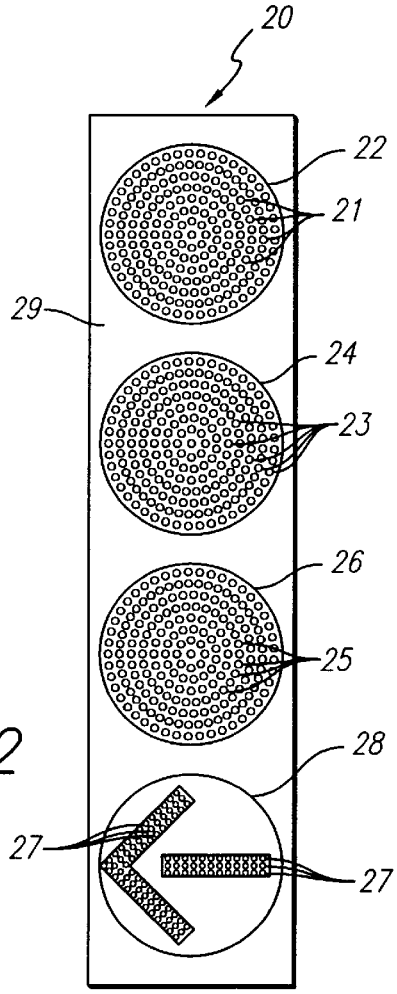
FIG. 2
PRIOR ART
FIG. 3
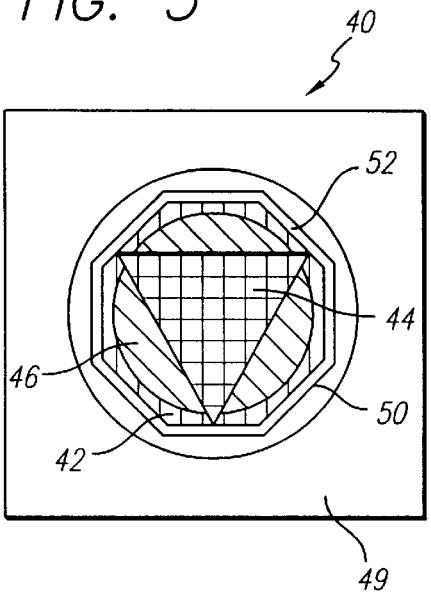
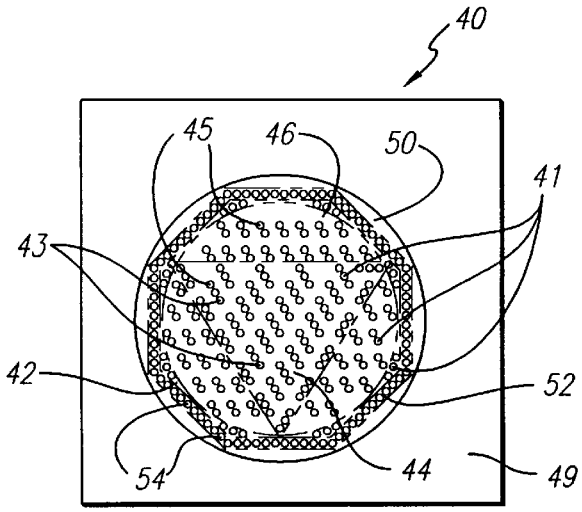
FIG. 4

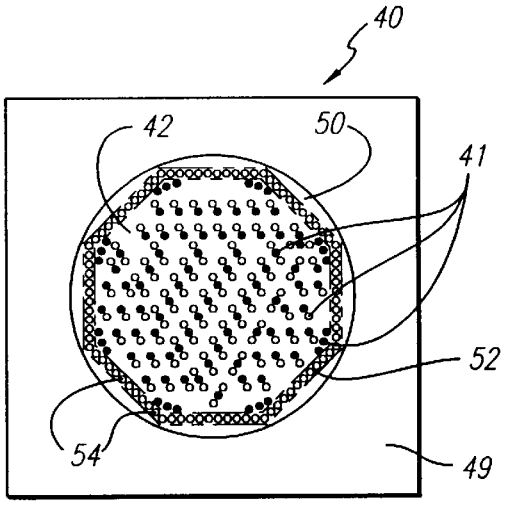
FIG. 6
FIG. 7
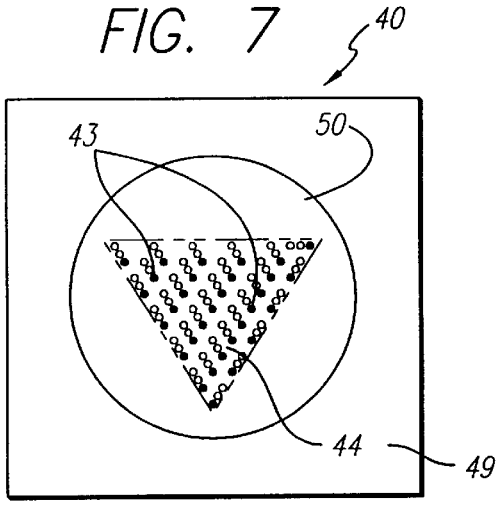
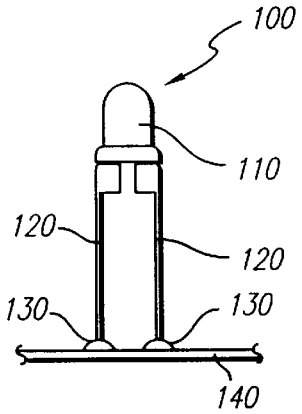
FIG.5
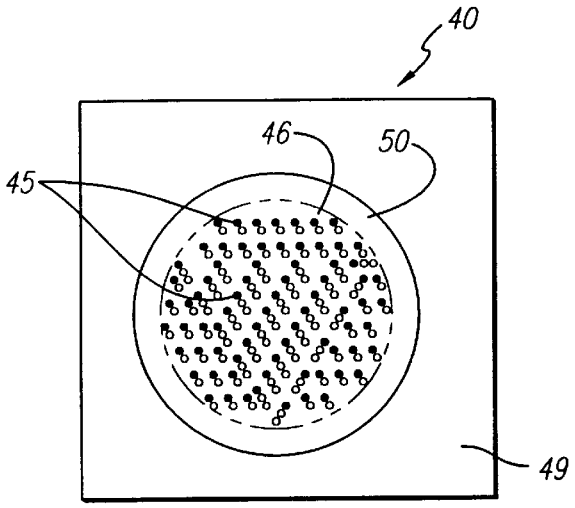
FIG.8
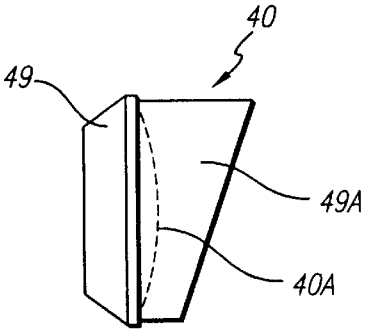
FIG.10
FIG.11A
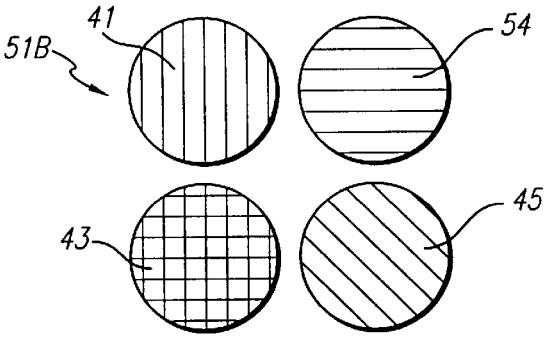

LED TRAFFIC LIGHT AND METHOD MANUFACTURE AND USE THEREOF

BACKGROUND OF THE INVENTION

1. Fields of Invention

The present invention relates to a traffic light invention, and, more particularly, relates to a new Light Emitting Diode (LED) traffic light apparatus and corresponding methods of manufacture and use thereof.

2. Discussion of Background and Prior Art

The typical conventional traffic light has a heavy housing unit which holds a vertical or horizontal arrangement of at least three different round signal lights each having a corresponding lens (See FIG. 1—Prior Art). The three round lights are a red signal light which represents "Stop", a yellow signal light which represents "Caution", and a green signal light which represents "Go". A red arrow signal light and/or a green arrow signal light, which are used for controlling protected turns, can also be added to the arrangement. In the conventional arrangement, the red signal light is produced by using an incandescent bulb (i.e. typically 67 to 150 watts) and a red filter. Similarly, the yellow signal light is produced by using an incandescent bulb and a yellow filter, and the green signal light is produced by using an incandescent bulb and a green filter. Furthermore, the red arrow signal light is produced by using an incandescent bulb and a filter that produces a red arrow, and the green arrow signal light is produced by using an incandescent bulb and a filter that produces a green arrow.

Each incandescent lamp (i.e. single round light or single arrow light) used in the typical traffic light consumes a fair amount of power (i.e. about sixty seven (67) to one hundred fifty (150) watts) in relative to a number of other types of light bulbs or light sources. Incandescent lamps have the disadvantage of producing a lot of heat when they are being used, and they do not produce useful light efficiently (i.e. only a small amount of light produced by incandescent lamps is in the visible spectrum). For example, only the red light of the incandescent lamp passes through the red filter lens and is used to provide the red signal light for a traffic light. Therefore, a lot of energy is wasted in producing the rest of the light and heat.

Furthermore, the incandescent lamps burn out and have to be replaced periodically (i.e. at least annually to conform with the National Traffic Safety Board regulations). Since the replacement of the bulbs for the incandescent lamps has to be done on site (i.e. at the intersection), a crew is usually necessary to perform this task. Therefore, the costs of replacing the incandescent lamp parts themselves and the personnel and labor required to perform these replacing services add to the costs of using and maintaining incandescent lamps for traffic lights.

Therefore, Light Emitting Diodes (LEDs) are being experimented with and used to replace incandescent lamps for traffic lights (See disclosure in *Tech Update* by E Source, November 1995, pp. 1–16 and Chapter 13 of E Source Publication, Secs. 13.1 to 13.2.2, 1994). The LED traffic light would also include the vertical or horizontal arrangement of at least three round signal lights (i.e. red, yellow, green) and can also include the protected turn signal (i.e. red arrow, green arrow) (See FIG. 2—Prior Art). Each of the signal lights includes a number of LEDs closely arranged together in the desired round or arrow pattern. The LED traffic light provides the advantages of generally consuming less power (i.e. single round light or single arrow light consumes about nine (9) to twenty five (25) watts of power), of producing at least red light (i.e. red signal light) more efficiently and very cost effectively, and of not burning out as often as an incandescent light. However, red light producing LEDs are designed only to provide red light, and they cannot be filtered to produce other colors.

LEDs can be changed to produce other colors by changing the ratios of various trace elements. Thus, yellow (amber) and green LEDs are available. Furthermore, the conventional traffic light design has been used for the LED traffic light (i.e. at least three different round signal lights each having a lens), and therefore, the typical heavy and bulky housing is still used to hold the round or arrow patterned LED traffic signal lights. Therefore, the costs and problems associated with providing, mounting, and maintaining the typical housing still exist. Heavy duty equipment (i.e. cables or poles) is still needed to hold and maintain the LED traffic light, and necessary personnel are needed to mount the LED traffic light.

Furthermore, the conventional LED traffic light still has the problem of allowing a driver or pedestrian to distinguish one light from the other only by its position on the three (3) light array. This problem is especially evident for persons that are color blind who may not be able to easily distinguish one color light from the other.

Furthermore, shapes of traffic signal lights may be difficult to distinguish from afar. Therefore, features that enhance and aid in the visibility of traffic signal lights are continuously needed and desired.

Therefore, an LED traffic light invention that is overall more efficient and cost effective, that has a less bulky, less expensive, and easy to mount housing unit, and that is designed so that each of the lights is more easily distinguishable and visible is needed and desired, and it is an object of the present invention to overcome the problems and limitations of the prior art that has been discussed.

SUMMARY OF THE INVENTION

Set forth is a brief summary of the invention in order to solve the foregoing problems and achieve the foregoing and other objects, benefits, and advantages in accordance with the purposes of the present invention as embodied and broadly described herein.

It is an object of the present invention to provide a new LED traffic light invention.

It is another object of the present invention to provide a new LED traffic light invention that has features which enhance and aid in the visibility of traffic signal lights to viewers.

It is still another object of the present invention to provide a new LED traffic light invention that is designed so that each of the lights is more easily distinguishable and visible.

It is a further object of the present invention to provide a new LED traffic light invention that is able to be controlled or programmed to provide traffic information.

It is still a further object of the present invention to overcome the problems and limitations of the prior art that has been discussed above.

Accordingly, it is an object and advantage of the present invention to provide a new traffic light apparatus comprising a housing having one single opening, at least three signals lights embedded into the at least one opening of the housing wherein each of the at least three signal lights are light emitting diodes arranged in a symbolic shape that is representative of one of the at least three signal lights, and at least one contrasting border embedded into the at least one opening of the housing wherein the at least one contrasting light border comprises light emitting diodes of contrasting color arranged to surround and border at least one of the at least three signal lights.

It is one aspect and advantage of the present invention to provide a new traffic light apparatus wherein one of the at least three signal lights is a red signal light formed by arranging and mounting red light emitting diodes in a universal stop sign shape, wherein one of the at least three signal lights is a yellow signal light formed by arranging and mounting yellow light emitting diodes in a universal caution sign shape, and wherein one of the at least three signal lights is a green signal light formed by arranging and mounting green light emitting diodes in a universal proceed sign shape.

It is another aspect and advantage of the present invention to provide a new traffic light apparatus wherein the at least one contrasting border surrounds and borders the red signal light.

It is a further aspect and advantage of the present invention to provide a new traffic light apparatus wherein the at least one contrasting border is at least one blinking contrasting border formed by blinking the light emitting diodes of contrasting color.

It is another aspect and advantage of the present invention to provide a new traffic light apparatus wherein the at least one symbolic shape is at least one universal traffic symbol.

It is still another aspect and advantage of the present invention to provide a new traffic light apparatus wherein the at least one symbolic shape is at least textual information.

Another object and advantage of the present invention is to provide a new traffic light apparatus comprising a housing having one single opening and light emitting diode clusters embedded into the at least one opening of the housing wherein the light emitting diode clusters are controlled to provide traffic light information.

It is one aspect and advantage of the present invention to provide a new traffic light apparatus wherein each of the light emitting diode clusters has at least three different colored light emitting diodes for activating one of at least three signal lights.

It is another aspect and advantage of the present invention to provide a new traffic light apparatus wherein the light emitting diode clusters further comprise contrasting colored light emitting diodes and wherein the contrasting colored light emitting diodes are controlled to surround and form a contrasting border around at least one of the at least three signal lights.

It is still another aspect and advantage of the present invention to provide a new traffic light apparatus that further comprises a microcontroller coupled to the light emitting diode clusters wherein the microcontroller is programmed to control the display of the traffic light information.

A further object and advantage of the present invention is to provide a method of using a new traffic light that includes the steps of providing a new traffic light with a housing having one single opening, at least three signals lights embedded into the at least one opening of the housing wherein each of the at least three signal lights are light emitting diodes arranged in a symbolic shape that is representative of one of the at least three signal lights, and at least one contrasting border embedded into the at least one opening of the housing wherein the at least one contrasting light border comprises light emitting diodes of contrasting color arranged to surround and border at least one of the at least three signal lights, mounting the new traffic light at a desired location, coupling the new traffic light to a power source, attaching the new traffic light to a control switch box to operate the traffic light, and controlling each of the at least three signal lights in its corresponding symbolic shape at appropriate times by using the control switch box.

A still further object and advantage of the present invention is to provide a method of using a new traffic light that includes the steps of providing a new traffic light apparatus having a housing having one single opening, and light emitting diode clusters embedded into the at least one opening of the housing wherein the light emitting diode clusters are controlled to provide traffic light information, mounting the new traffic light at a desired location, coupling the new traffic light to a power source, attaching the new traffic light to a control switch box to operate the traffic light, and controlling the light emitting diode clusters to provide the traffic light information by using the control switch box.

BRIEF DESCRIPTION OF THE DRAWINGS

FIG. 1—Front view of a prior art conventional traffic light showing three round signal lights.

FIG. 2—Front view of a prior art Light Emitting Diode (LED) conventional traffic light showing three round signal lights and one arrow signal light wherein each signal light has an individual lens.

FIG. 3—Front view of one embodiment of the present invention Light Emitting Diode (LED) traffic light having a single lens that is able to display one of the three signal lights (i.e. red, yellow, or green) within the single lens area wherein each signal light is arranged in a symbolic shape that further represents one of the traffic signals and wherein a contrasting colored light border surrounds one of the symbolic shape signal light.

FIG. 4—Front view of the present invention LED traffic light of FIG. 3 clearly showing the LED lights for each of the three signal lights and the border.

FIG. 5—Side view of a light emitting diode (LED) mounted to a circuit board that can be coupled to a power source and switch(es) that control the activation and de-activation of the LED.

FIG. 6—Front view of the present invention LED traffic light of FIG. 4 clearly showing the illumination of the red signal light in the arrangement of a octagon (i.e. stop sign shape) with the contrasting border of LED lights surrounding the octagonal shape.

FIG. 7—Front view of the present invention LED traffic light of FIG. 4 clearly showing the illumination of the yellow signal light in the arrangement of a triangle (i.e. caution sign shape).

FIG. 8—Front view of the present invention LED traffic light of FIG. 4 clearly showing the illumination of the green signal light (i.e. go sign shape) in the arrangement of a circle.

FIG. 10—Side view of the present invention LED traffic light of FIG. 4.

FIG. 11A—Detail view of an LED cluster of FIG. 11 showing the four different colored LEDs.

DETAILED DESCRIPTION OF THE PREFERRED EMBODIMENT

Figure 9:
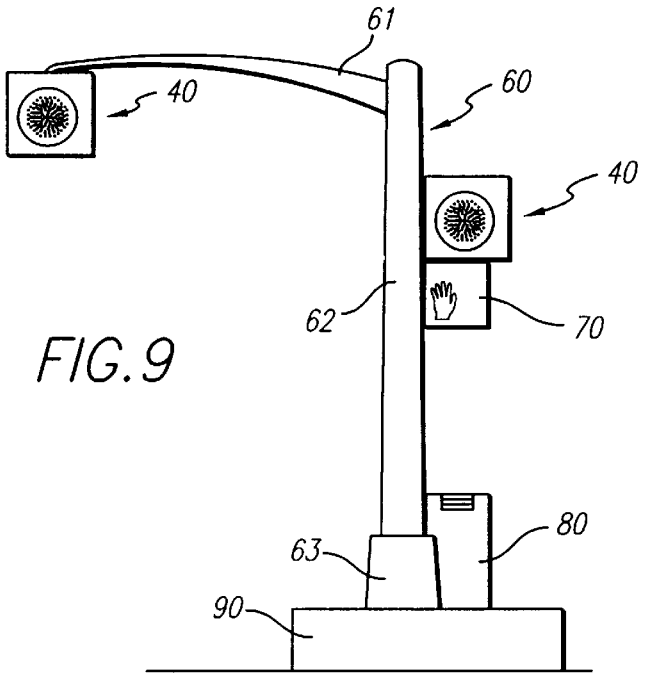
FIG. 9—Front view of two LED traffic lights of FIG. 4 mounted to a street post wherein one of the lights hangs generally in the middle of the street intersection while the other light is mounted to the post generally at a side of the street.

The present invention generally discloses a newly designed and constructed LED traffic light 40 and method of manufacturing and using the LED traffic light 40. FIG. 1 shows a conventional traffic light 10 that utilizes incandescent lamps which is in the prior art. As stated earlier, the conventional traffic light 10 has a heavy housing 19 and three different round signal lights (i.e. red signal light 12 that uses a red filter 11, yellow or amber signal light 14 that uses a yellow filter 13, and green signal light 16 that uses a green filter 15). However, the conventional traffic light 10 has the disadvantages of consuming a fair amount of power, producing heat when being used, and wasting and not producing the desired color light efficiently.

FIG. 2 shows a Light Emitting Diode (LED) conventional traffic light 20. As stated earlier, Light Emitting Diodes (LEDs) have been used to replace incandescent lamps for the conventional traffic light. The conventional LED traffic light 20 also has a heavy housing 29 and three different signal lights in which each signal light includes a number of LEDs closely arranged together in the desired round or arrow pattern (i.e. red signal light 22 comprising a number of red LEDs 21 arranged in a circular pattern, yellow or amber signal light 24 comprising a number or yellow LEDs 23 arranged in a circular pattern, green signal light 26 comprising a number of green LEDs 25 arranged in a circular pattern, and green arrow signal light 28 comprising a number of green LEDs 27 arranged in an arrow pattern). The LED lights for each signal light are mounted or soldered onto a circuit board, and the circuit board is coupled to a power source and switches that control the activation and deactivation of various lights. FIG. 5 shows a typical LED 100 having a light producing element 110 and terminals 120 which are mounted and soldered at joints 130 to circuit board 140.

The conventional LED traffic light 20 provides the advantages of consuming less power, producing red light (i.e. the red signal light 22) more efficiently and cost effectively, and not burning out as often as an incandescent lamp. The conventional LED traffic light 20 has the disadvantages of having a heavy and bulky housing 29 to hold the traffic signal lights 22, 24, 26, and 28, and therefore, the costs, problems, and hazards associated with providing, mounting, and maintaining the heavy housing 29 still exist. Furthermore, the conventional incandescent traffic light 10 or conventional LED traffic light 20 has the problem of not allowing a person (i.e. including but not limited to a driver or pedestrian) to easily distinguish one light from the other. Also, shapes of prior art traffic signal lights may be difficult to distinguish from afar. Therefore, features, such as a contrasting border or reinforcing textual information, enhance and aid in the visibility of LED traffic signal lights and are therefore disclosed by the present invention.

FIGS. 3 and 4 show one embodiment of the present invention new LED traffic light 40 having a contrasting LED colored border 52 around the red signal light (i.e. octagon) 42. The new LED traffic light 40 has a housing 49 that provides at least three signal lights 42, 44, and 46. The three signal lights 42, 44, and 46 are all embedded in a single opening 50 of housing 49, and the single opening 50 is covered by a single lens 40A as shown in FIG. 10. The housing 49 is made of typical formed steel or any other suitable material having a highly reflective inside surface. The housing 49 may be made, round, rectangular, square, or any other suitable shape, and it does not have any penetrations except for the wires that are attached to the light emitting diodes (LEDs). The outer rim of the opening 50 of housing 49 allows the lens 40A to be fixed over the opening 50 with a flexible sealing ring to prevent moisture, debris, etc. from entering the housing 49 (i.e. as shown in FIG. 10). The lens 40A is different from the conventional "light collecting" lens in that it is larger (i.e. fifteen (15) to eighteen (18) inches in diameter) than the conventional lens, and the lens 40A is designed not only to collect light but to focus it to obtain maximum projection from the opening 50 towards a viewer. This maximum projection can be achieved in many different ways, and in this specific embodiment, it is achieved by using four sided, pyramid-like projections into the light chamber that collect light from all angles and focus the light from the opening 50 and forward to a viewer.

The single lens 40A is in turn covered by a lens enclosure 49A as shown in Fig. 10 in which the lens enclosure 49A directs the signal light towards viewers (i.e. including but not limited to persons on the street or ground surface). The LED lights for each signal light for traffic light 40 are also mounted or soldered onto a circuit board in the similar manner as traffic light 20, and the LED lights are also activated and controlled by a power source and switch(es). To provide reflectivity of the signal lights, the LED lights are mounted in reflective metal cells that are set into the rear of the opening 50 of housing 49.

The LED traffic light 40, however, provides a single lens traffic light instead of a traffic light with multiple number of lenses. The housing 49 is much smaller and lighter than the conventional traffic light 20 or 30, and the traffic light 40 is much easier and less expensive to mount and maintain. Therefore, the overall costs for the purchase, operation, and maintenance of the LED traffic light 40 is less than the conventional traffic lights 20 or 30. Furthermore, the LEDs for traffic signal lights 42, 44, and 46 are mounted to a single circuit board in the similar manner as shown in FIG. 5. FIG. 3 shows that the LED traffic light 40 can be activated to one of the traffic signal light colors.

FIG. 4 shows that the LEDs are arranged in a generally common area of the circuit board to allow the activation and display of one of the signal lights in a corresponding symbolic shape (i.e. including but not limited to universal symbols). In FIG. 4, the red signal light 42 occupies the largest area, and it includes red LEDs 41 spread out, arranged, and mounted to a circuit board in an octagon shape (i.e. universal stop sign shape). From a distance or afar, however, it may be difficult for persons to distinguish between the octagon shape and the circular shape (i.e. stop and go signals respectively). Therefore, a border 52 of contrasting color LEDs 54 (i.e. different color other than the color of the octagon) is placed around the octagon shape and illuminated to further enhance and define the stop sign or octagon shape thereof. The LEDs 54 and border 52 are preferably made to be a white color or at least a contrasting visible color relative to the red color so that the viewers are able to more noticably see the stop signal. If desired, the border 52 may be made to blink or flash (i.e. by blinking all of the LEDs 54) in order to further capture the attention of and provide warning to the persons (i.e. such as complacent or preoccupied drivers or pedestrians) so that they are made aware of the illuminated stop signal (i.e. red octagon signal). The green signal light 46 occupies the second largest area, and it includes green LEDs 45 spread out, arranged, and mounted to the circuit board in a circular shape. In those areas in which the red signal light 42 and the green signal light 46 commonly overlap, clusters of two LEDs (i.e. red LEDs 41 and green LEDs 45) exist. Furthermore, in FIG. 4, the yellow signal light 44 occupies the least area, and it includes yellow LEDs 43 spread out, arranged, and mounted to the circuit board in a triangle shape (i.e. universal caution sign shape). In those areas in which the red signal light 42, the yellow signal light 44, and the green signal light 46 commonly overlap, clusters (i.e. overlap) of three LEDs (i.e. red LEDs 41, yellow LEDs 43, and green LEDs 45) exist. The colors of the LEDs 41, 43, and 45 are not in any way limited to the color arrangements disclosed in this specification, and any suitable colors may be used. For example, the color of the CAUTION signal is not limited to the color yellow, and other appropriate colors such as red and white may be used.

The LED lights for new traffic light 40 are mounted or soldered onto the circuit board in the similar manner as shown in FIG. 5, and the LED lights are also activated and controlled by a power source and switch(es). FIG. 6 shows that when the red signal light 42 is activated, the red LEDs 41 (i.e. either individually or within the clusters) light up in the octagon shape (i.e. stop sign shape). The contrasting LEDs 54 are also illuminated or blinking at this time to form a contrasting border 52 around the octagon shape so that the octagon shaped signal is more clearly enhanced, defined, and noticeable to the viewers of the new LED traffic light 40. FIG. 7 shows that when the yellow or amber signal light 44 is activated, only the yellow LEDs 43 (i.e. either individually or within the clusters) light up in the triangle shape (i.e. caution sign shape). FIG. 8 shows that when the green signal light 46 is activated, only the green LEDs 45 (i.e. either individually or within the clusters) light up in the circular shape. The activation of the traffic signal lights are controlled by switch(es) (i.e. including but not limited to programmed switch(es).

FIG. 9 shows the new traffic lights 40 mounted to a street post 60. The street post 60 includes a vertical pole structure 62 that is attached to a base 63 (i.e. concrete base), and the base 63 is fixed to a cement or concrete surface (i.e. sidewalk surface). A horizontal pole structure 61 appends perpendicularly from the vertical pole structure 62. A new LED traffic light 40 is mounted generally at the end of the horizontal pole structure 61 so that the new traffic light 40 hangs generally above and in the middle of the intersection. In FIG. 9, another new LED traffic light 40 is mounted to the vertical pole structure 62 so that it generally hangs above the concrete (i.e. sidewalk) surface that is next to the street surface. A pedestrian signal light 70 is shown mounted to the vertical pole structure 62 below the second new LED traffic light 40. The new traffic lights 40 are attached to a power source and controlled by the switch box 80 located near the base 63. A light signal in its corresponding symbolic shape is activated at the appropriate times via the control of the programmed switch box 80.

Alternatively, the new traffic signal 40 can be rectangular, round, square, or any other suitable shape having a single lens. Also, the LEDs of new traffic signal 40 can be arranged in a common area in the shapes of letters that spell the word "STOP" for the red LEDs 41, the word "GO" for the green LEDs 45, and "CAUTION" for the yellow or amber LEDs 43. A contrasting colored border 52 of contrasting LEDs 54 are also arranged to generally surround the red LEDs 41 that form the word "STOP".

Figure 11:
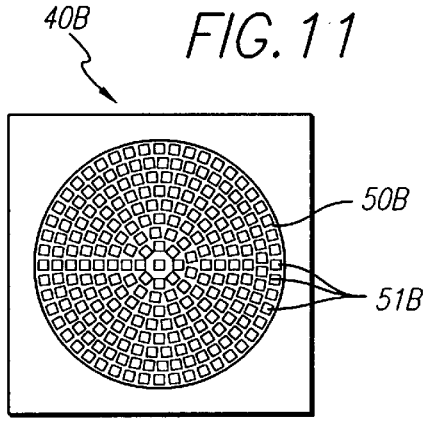
FIG. 11—Front view of an alternative embodiment of the present invention LED traffic light showing a number of LED clusters wherein each cluster has four different colored LEDs and the LED traffic light is programmed to control the LED clusters as needed or desired.
Figure 12:
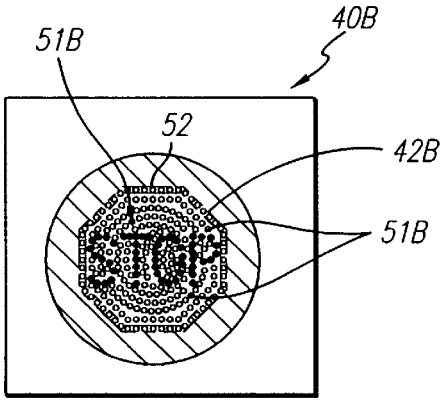
FIG. 12—Front view of the present invention LED traffic light of FIG. 11 further showing the illuminated "STOP" signal and text and contrasting colored LED border.
Figure 13:
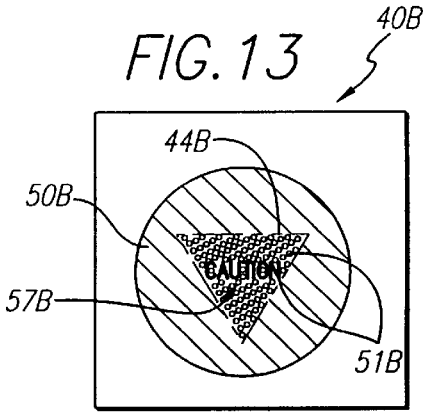
FIG. 13—Front view of the present invention LED traffic light of FIG. 11 showing the illuminated "CAUTION" signal and text.
Figure 14:
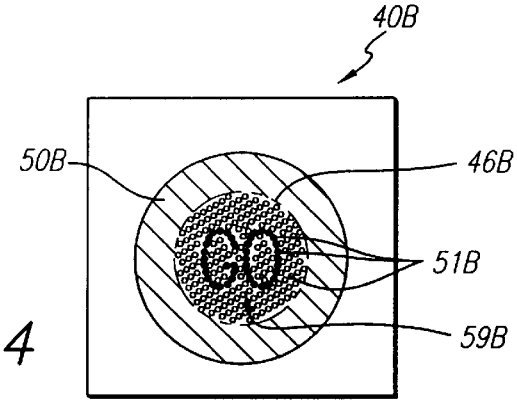
FIG. 14—Front view of the present invention LED traffic light of FIG. 11 showing the illuminated "GO" signal and text.

FIGS. 11 to 14 show another embodiment of the new present LED traffic light invention 40B. FIG. 11 shows that new LED traffic light 40B has a number of LED clusters 51B within an entire area 50B. Each cluster 51B has four different colored LEDs, that is, a red LED 41, a yellow LED 43, a green LED 45, and a contrasting colored LED 54 (see FIG. 11A). The new traffic light 40B is programmed to activate the LED clusters 51B so that text and/or signal light shapes (i.e. octagon, circle, and triangle) appear as desired or needed. For example, when the new traffic light 40B is to activate the red signal light, then red LEDs 41 and contrasting colored LEDs 54 of respective LED clusters 51B are activated in the appropriate manner within the area 50B to provide a stop sign shape (octagon shape) 42B and/or the word "STOP" 53B and to provide the contrasting colored border 52 as shown in FIG. 12. When the new traffic light 40B is to activate the yellow signal light, then yellow LEDs 43 of respective, appropriate LED clusters 51B are activated within the area 50B to provide a caution sign shape (upside down triangular shape) 44B and/or the word "CAUTION" 57B as shown in FIG. 13. When the new traffic light 40B is to activate the green signal light, then green LEDs 45 of respective, appropriate LED clusters 51B are activated within the area 50B to provide a go sign shape (circular shape) 46B and/or the word "STOP" 59B as shown in FIG. 14. The new LED traffic light 40B may also be programmed or set up to display other information (i.e. similar to a message board) as needed or desired by using and controlling the operations of the LED clusters 51B. Also, the LED clusters 51B may be configured in any suitable and/or desirable manner, that is, the LED clusters 51B are not in any way limited to the cluster arrangements disclosed in this specification.

The principles of the present invention of providing a single lens traffic light instead of a multiple lens traffic light are not limited to LEDs, but other types of suitable lights or light sources which are able to provide the appropriate colored lights can be arranged, activated, and used in the same or similar manner. Also, the present invention is not limited to being used with just English text and words, and any suitable language may be used with the present invention.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable other skilled in the art to best utilize the invention in various embodiments and with various modifications as are suited to the particular use contemplated.

What is claimed is:

1. A new traffic light apparatus comprising:

a housing having one single opening, at least three signals lights embedded into the at least one opening of the housing wherein each of the at least three signal lights are light emitting diodes arranged in a symbolic shape that is representative of one of the at least three signal lights, and at least one contrasting border embedded into the at least one opening of the housing wherein the at least one contrasting light border comprises light emitting diodes of contrasting color arranged to surround and border at least one of the at least three signal lights.

2. The new traffic light apparatus according to claim 1 wherein one of the at least three signal lights is a yellow signal light formed by arranging and mounting yellow light emitting diodes in a universal caution sign shape.

3. The new traffic light apparatus according to claim 1 wherein one of the at least three signal lights is a green signal light formed by arranging and mounting green light emitting diodes in a universal proceed sign shape.

4. The new traffic light apparatus according to claim 1 wherein the at least one contrasting border is at least one blinking contrasting border formed by blinking the light emitting diodes of contrasting color.

5. The new traffic light apparatus according to claim 1 wherein the at least one symbolic shape is at least one universal traffic symbol.

6. The new traffic light apparatus according to claim 1 wherein the at least one symbolic shape is at least textual information.

7. The new traffic light apparatus according to claim 1 further comprising:

a lens placed over the one single opening for collecting light from the light emitting diodes of each of the at least three signal lights and focusing the light towards a viewer.

8. The new traffic light apparatus according to claim 1 further comprising:

a lens enclosure surrounding the one single opening for directing light from the one single opening towards a viewer.

9. The new traffic light apparatus according to claim 1 wherein one of the at least three signal lights is a red signal light formed by arranging and mounting red light emitting diodes in a universal stop sign shape.

10. The new traffic light apparatus according to claim 9 wherein the at least one contrasting border surrounds and borders the red signal light.

11. The new traffic light apparatus according to claim 1 wherein light emitting diode clusters are embedded into the at least one opening of the housing and wherein the light emitting diode clusters are controlled to provide traffic light information.

12. The new traffic light apparatus according to claim 11 further comprising:

a microcontroller coupled to the light emitting diode clusters wherein the microcontroller is programmed to control the display of the traffic light information.

13. The new traffic light apparatus according to claim 11 wherein each of the light emitting diode clusters has at least three different colored light emitting diodes for activating one of at least three signal lights.

14. The new traffic light apparatus according to claim 13 wherein one of the at least three different colored light emitting diodes comprises red colored light emitting diodes and wherein one of the at least three signal lights is a red signal light activated by the red colored light emitting diodes.

15. The new traffic light apparatus according to claim 13 wherein one of the at least three different colored light emitting diodes comprises yellow colored light emitting diodes and wherein one of the at least three signal lights is a yellow signal light activated by the yellow colored light emitting diodes.

16. The new traffic light apparatus according to claim 13 wherein one of the at least three different colored light emitting diodes comprises green colored light emitting diodes and wherein one of the at least three signal lights is a green signal light activated by the green colored light emitting diodes.

17. The new traffic light apparatus according to claim 13 wherein the light emitting diode clusters further comprise contrasting colored light emitting diodes and wherein the contrasting colored light emitting diodes are controlled to surround and form a contrasting border around at least one of the at least three signal lights.

18. The new traffic light apparatus according to claim 17 wherein the at least one of the at least three signal lights that the contrasting border surrounds is a red signal light.

19. A method of using a new traffic light comprising the steps of:

providing a new traffic light with a housing having one single opening, at least three signals lights embedded into the at least one opening of the housing wherein each of the at least three signal lights are light emitting diodes arranged in a symbolic shape that is representative of one of the at least three signal lights, and at least one contrasting border embedded into the at least one opening of the housing wherein the at least one contrasting light border comprises light emitting diodes of contrasting color arranged to surround and border at least one of the at least three signal lights, mounting the new traffic light at a desired location, coupling the new traffic light to a power source, attaching the new traffic light to a control switch box to operate the traffic light, and controlling each of the at least three signal lights in its corresponding symbolic shape at appropriate times by using the control switch box.

20. The method of claim 19 wherein light emitting diode clusters are embedded into the at least one opening of the housing.

* * * * *